US011056824B2

(12) United States Patent
Meshram et al.

(10) Patent No.: US 11,056,824 B2
(45) Date of Patent: Jul. 6, 2021

(54) WEATHER PROTECTING (WP) HOUSING FOR COAXIAL CABLE CONNECTORS

(71) Applicant: John Mezzalingua Associates, LLC, Liverpool, NY (US)

(72) Inventors: Nikhil B. Meshram, Liverpool, NY (US); Adam T. Nugent, Canastota, NY (US); Christopher P. Natoli, Baldwinsville, NY (US); Brandon Stevens, Liverpool, NY (US)

(73) Assignee: John Mezzalingua Associates, LLC, Liverpool, NY (US)

( * ) Notice: Subject to any disclaimer, the term of this patent is extended or adjusted under 35 U.S.C. 154(b) by 0 days.

(21) Appl. No.: 17/071,741

(22) Filed: Oct. 15, 2020

(65) Prior Publication Data

US 2021/0028575 A1 Jan. 28, 2021

Related U.S. Application Data

(63) Continuation of application No. 16/640,174, filed as application No. PCT/US2018/048308 on Aug. 28, 2018, now Pat. No. 10,811,814.

(60) Provisional application No. 62/550,986, filed on Aug. 28, 2017.

(51) Int. Cl.

| | |
|---|---|
| ***H01R 9/05*** | (2006.01) |
| ***H01R 13/52*** | (2006.01) |
| ***H01R 24/38*** | (2011.01) |

(52) U.S. Cl.

CPC ..... *H01R 13/5213* (2013.01); *H01R 9/05* (2013.01); *H01R 24/38* (2013.01)

(58) Field of Classification Search

CPC ..... H01R 13/5213

USPC ..... 174/82

See application file for complete search history.

(56) References Cited

U.S. PATENT DOCUMENTS

| | | | | |
|---|---|---|---|---|
| 3,905,672 | A | 9/1975 | Anhalt et al. | |
| 4,702,710 | A | 10/1987 | Dittman et al. | |
| 6,007,378 | A | 12/1999 | Oeth | |
| 2009/0029590 | A1* | 1/2009 | Sykes | H01R 9/0518 439/585 |
| 2012/0115365 | A1* | 5/2012 | Zhou | H01R 13/5845 439/625 |

(Continued)

FOREIGN PATENT DOCUMENTS

GB 2274025 A 7/1994

OTHER PUBLICATIONS

European Patent Office, European Search Report, Application No. 18852122.3, dated Mar. 29, 2021 (7 pages).

*Primary Examiner* — Stanley Tso

(74) *Attorney, Agent, or Firm* — Barclay Damon LLP

(57) ABSTRACT

A productive housing for a coaxial cable connector comprising an elastomeric housing disposed over and engaging a connector and having a plurality of longitudinal slots formed into the inner mold line (IML) surface of the elastomeric housing. The longitudinal slots function to reduce the surface area of frictional engagement between the intermediate surface and the corresponding peripheral surface of the coaxial cable connector. The longitudinal slots serve as a longitudinal passageway for the movement of trapped air from one IML surface to another so as to prevent the built-up of air and/or inducing a pocket of suction resisting the separation of the housing from the jumper cable.

17 Claims, 4 Drawing Sheets

(56) References Cited

U.S. PATENT DOCUMENTS

2014/0148044 A1* 5/2014 Balcer ..... H01R 9/0524
439/460
2015/0295368 A1* 10/2015 Wilson ..... H01R 24/40
439/578

* cited by examiner

WEATHER PROTECTING (WP) HOUSING FOR COAXIAL CABLE CONNECTORS

CROSS-REFERENCE TO RELATED APPLICATIONS

This application is a continuation of U.S. patent application Ser. No. 16/640,174, filed Feb. 19, 2020, which is the National Stage of International Application No.: PCT/US2018/048308, filed Aug. 28, 2018, which claims priority to U.S. Provisional Patent Application No. 62/550,986, entitled WEATHER PROTECTING (WP) HOUSING FOR COAXIAL CABLE CONNECTORS filed on Aug. 28, 2017. The complete specification of each application is hereby incorporated by reference in its entirety.

BACKGROUND

Coaxial cables are typically connected to interface ports, or corresponding connectors, for the operation of various electronic devices, such as cell phones, televisions and video recording devices. Typically, coaxial cables are installed on cell towers, in harsh outdoor environments which subject the cable/connectors to rain, snow, ice, wind and other elements. To protect the cable/connectors from the elements, a variety of weatherproofing systems have been devised providing critical protection for electrical connectors installed on such cellular antennas/towers. Initially, weather proofing methods included the use of a fluid butyl sealant in combination with mastic tape disposed about the coaxial cable/connectors which were difficult to manipulate and messy to clean-up. Other, more sophisticated, Weather Protection Systems (WPS) in use today, include a soft silicone boot/sleeve which covers and protects most or all of the cable connection. That is, a rather large boot slides over the connection to produce a seal on both sides of the connection.

It will be appreciated that most cable connectors/interface ports present a variety of irregular surfaces, e.g., a threaded surface, polygonal surfaces (defining a hex exterior configuration), a plurality of steps, etc., which can be difficult to protect due to problems associated with producing a reliable seal over such irregular surfaces. As a result, environmental elements can penetrate the cable connections causing problems with cellular communications.

One difficulty associated with the assembly of conventional WPS devices relates to the inability to slide an elastomeric boot over connectors which vary in size. That is, an operator must typically carry a plurality of boots which vary in diameter dimension, i.e., the inner mold line dimension, to allow the rubber boot to slide onto, and off of, the electrical connector. The diameter dimension thereof may vary only slightly from one connector to another which causes the build-up or suction of air as the operator attempts to slide the rubber boot over the body of the connector. Should the operator select a boot which is forcibly installed, the improperly mated surfaces can lead to weather-induced degradation of the connector, and ultimately to increased replacement costs. With respect to the latter, the time associated with: (i) travel to and from a remotely-located tower, (ii) climbing up and down a lofty antenna, and (iii) removal and reassembly of a connector assembly can add considerable time and effort associated with the repair of an improperly or incorrectly installed coaxial cable connector.

Accordingly, there is a need to overcome, or otherwise lessen the effects of, the disadvantages and shortcomings described above.

SUMMARY

A protective housing is provided for a coaxial cable connector comprising an elastomeric housing disposed over and engaging a connector. The boot and having a plurality of longitudinal slots formed into the inner mold line (IML) surface of the elastomeric boot. The longitudinal slots function to reduce the surface area of frictional engagement between the intermediate surface and the corresponding peripheral surface of the coaxial cable connector. The longitudinal slots serve as a longitudinal passageway for the movement of trapped air from one IML surface to another so as to prevent the built-up of air and/or inducing a pocket of suction resisting the separation of the boot from the jumper cable.

BRIEF DESCRIPTION OF THE DRAWINGS

Additional features and advantages of the present disclosure are described in, and will be apparent from, the following Brief Description of the Drawings and Detailed Description.

DETAILED DESCRIPTION

A weather protecting boot is described for providing water, wind, ice sand and foreign object damage to coaxial cable connections. As described in the Background of the Invention, such weather protection boots are typically disposed over coaxial cables connectors used outdoors, i.e., typically for connections made on cellular communications towers, i.e., between jumper cables and telecommunications antennas.

A typical jumper cable employs a coaxial cable having a cable connector disposed at each end. A coaxial cable typically comprises: (a) a conductive, central wire, tube, strand or inner conductor; (b) a cylindrical or tubular dielectric, or insulator that receives and surrounds the inner conductor; (c) a conductive tube or outer conductor that receives and surrounds the dielectric or insulator; and (d) a sheath, sleeve or outer jacket that receives and surrounds the outer conductor. The outer conductor may be corrugated, i.e., defining a plurality of peaks and valleys, to facilitate flexing or bending of the cable relative to an elongate axis.

The connectors may be any of a standard variety including F-type, hyperboloid, RF, Fiber Optic connectors. A typical coaxial cable connector may include: (a) a connector housing or connector body; (b) a nut or coupler that receives, and rotates relative to, the connector body; (c) a post interposing the dielectric insulator and the outer conductor to provide an electrical ground path from the outer conductor to an interface port or connector and (d) a compressor or fastener disposed over the outer jacket, in the region of the post, to mechanically and electrically couple the connector to the coaxial cable.

In one embodiment of the invention, a weather protecting/proofing boot such as the cover 100 illustrated in FIGS. 1-5, is configured to enclose part or all of the cable connector 102. The weather protecting/proofing protective housing 100 functions to provide an environmental seal to prevent the infiltration of environmental elements, such as rain, snow, ice, salt, dust, debris and air pressure, into the connector 104 and an interface port (not shown). The terms "weather-proofing" and "weather-protecting" are used interchangeably herein inasmuch as the assembly provides either or both of a geometric configuration which either weather proofs or provides protection against the elements.

Figure 1:
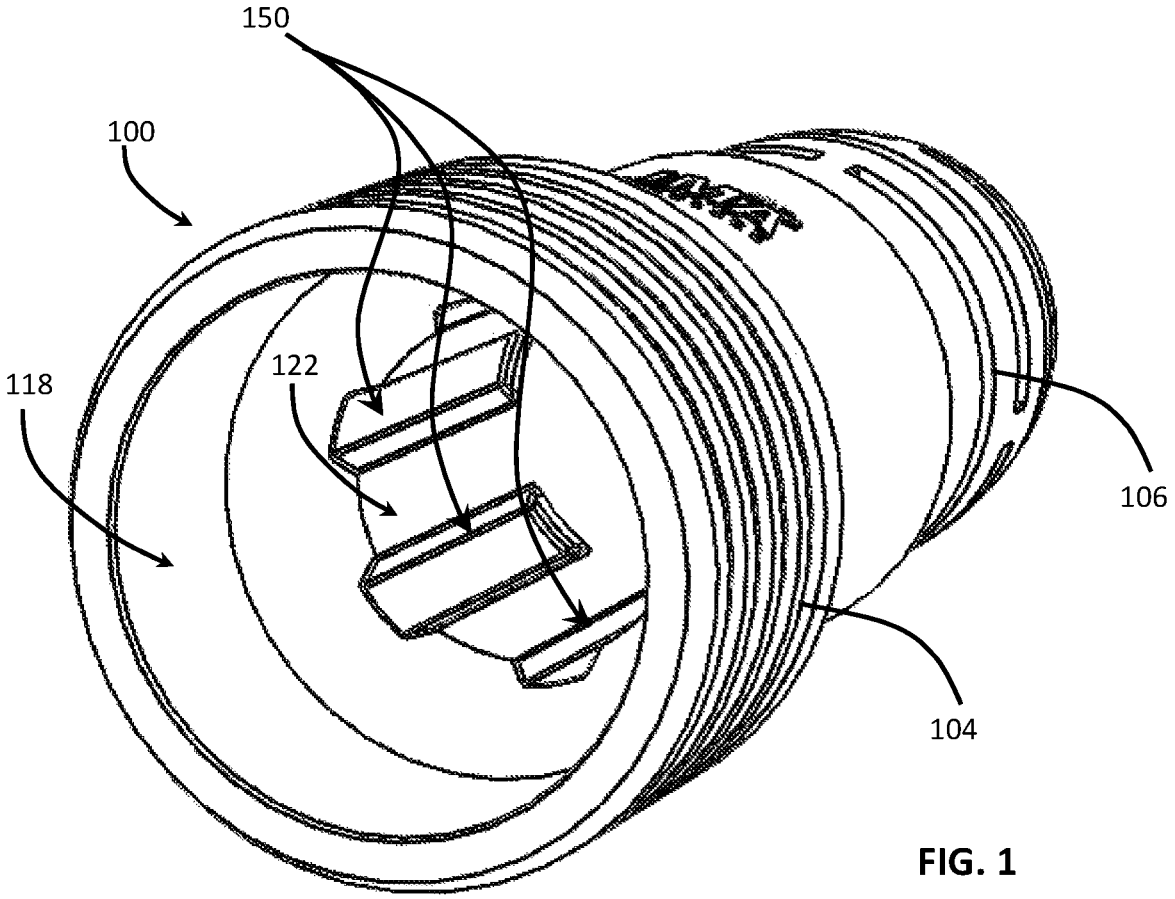
FIG. 1 is a perspective view of a weather protection boot according to one embodiment of the invention wherein a plurality of internal slots provide greater flexibility, reliability and reduce cost associated with the installation and repair of weather-protected telecommunications jumper cables.
Figure 2:
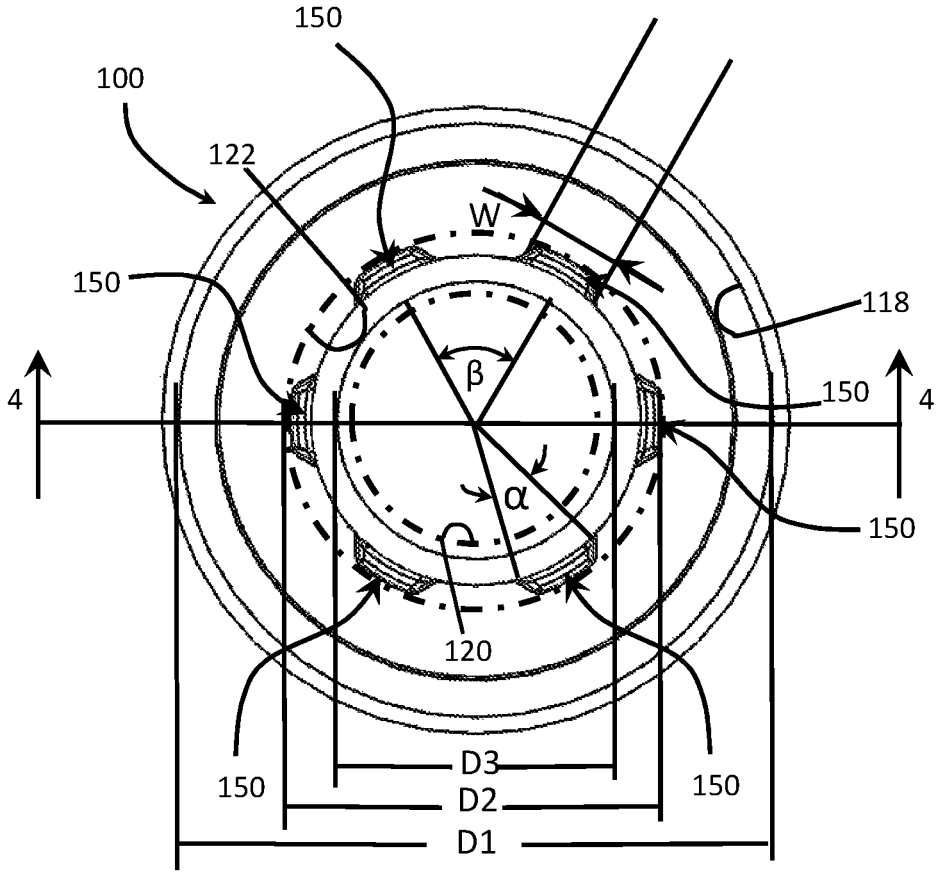
FIG. 2 is an end view of the weather protection boot according to the embodiment shown in FIG. 1.
Figure 3:
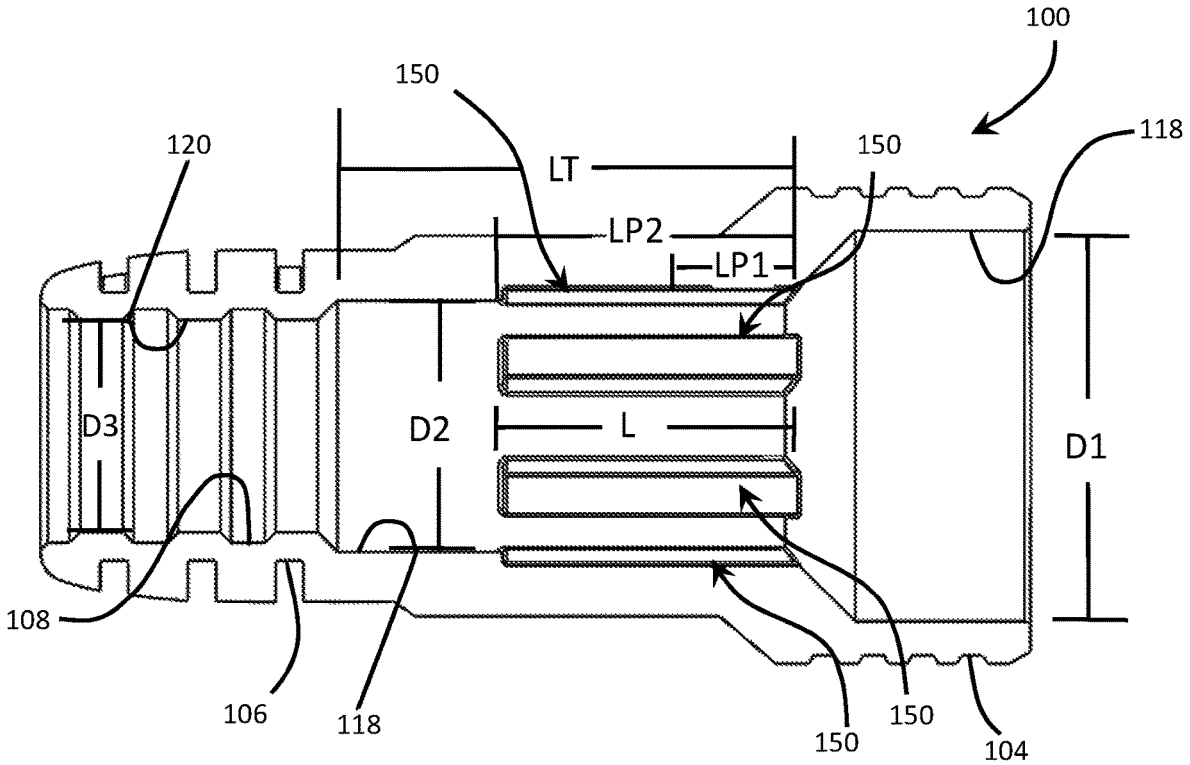
FIG. 3 is a cross-sectional view of the weather protection boot taken substantially along line 4-4 of FIG. 3.

The weather protecting/proofing housing 100 may be constructed from a material having a suitable foldable, stretchable or flexible construction or characteristic. Such flexible materials may include synthetic rubber, natural rubber or a silicon-based material. In FIGS. 1-3, the protective housing 100 may having a plurality of different inner diameters D1, D2, D3 and a plurality of annular rings or grooves 104, 106, 108 disposed along various portions of the protective housing 100. More specifically, the protective housing defines at least three (3) diameters D1, D2, D3 corresponding to a different portion of the connector or the coaxial cable. For example, diameters D1 and D2 correspond to the coupler and body portions, 110, and 112, respectively, of the cable connector 102. Diameter D3 corresponds to the outer surface 114 of the coaxial cable 116. As such, the inner surfaces of the protective cover 100 conforms to, and physically engages, outer surfaces 110, 112 of the connector 102 and the outer periphery of the cable 116 to establish a tight environmental seal.

In the described embodiment, the largest diameter D1 is defined by the first inner mold line (IML) surface 118 which corresponds to and engages the coupler 110 of the connector 102. The smallest diameter D3 is defined by a second IML surface 120 which corresponds and engages to the outermost surface 114 of the coaxial cable 116. Finally, an intermediate diameter D2 is defined by an intermediate IML surface 122 which corresponds and engages the body 112 of the connector 102. Accordingly, the protective housing 100 engages at least two peripheral surfaces of the connector 102, i.e., the coupler 110 and the body 112, in addition to the outer peripheral surface 114 of the coaxial cable 116.

The outer peripheral surface 114 of the coaxial cable 116 may be the compliant outer elastomer jacket (not shown) of the coaxial cable 102. In other embodiments, such as the embodiment illustrated in FIGS. 4 and 5, the outer peripheral surface 114 is defined by a corrugated polyvinyl-chloride (PVC) cover disposed over the compliant outer elastomeric jacket (not shown) of the coaxial cable 102. As part of this embodiment, the inventors discovered that certain birds, indigenous to certain parts of the globe, have a natural (or unnatural) desire to gnaw on and ingest the rubber or elastomeric materials used to fabricate the outer compliant jacket of the coaxial cable 102. For example, parrots, indigenous to the country of Australia, appear to have an affinity for gnawing on, and ingesting, elastomeric materials which tend to damage and expose the outer conductor of the cable 102. These same inventors learned that other materials appeared to be less attractive to the elastomer-ingesting parrots of the Australian outback. That is, the inventors discovered that the birds did not have the same affinity for polyvinyl-chloride (PVC) materials. Consequently, the inventors covered the compliant elastomeric outer jacket with a peripheral layer 114 (see FIG. 4) of corrugated PVC. Consequently, the smallest diameter D3 of the inner mold line surface 120 corresponds to and engages a bird-protecting corrugated PVC layer 114 of the coaxial cable 102. It will be appreciated that the protective housing 100 may also comprise an outer layer of Polyvinyl-Chloride (PVC) material to prevent birds form ingesting the protective housing 100. The PVC portion of the housing 100 may be integrally molded with the boot, or alternatively, include a conically-shaped cover disposed over the protective housing 100.

While each of these inner mold line surfaces establish a tight environmental seal, as discussed in the Background of the invention, certain advantages are achievable by using a housing which protects multiple configurations of the coaxial cable connector 102. As such, an operator no longer needs to carry a large inventory of housings, i.e., each having slightly different IML dimensions. In contrast, the operator only needs to carry a single multi-use protective housing capable of protecting a variety of connectors and housing assemblies. Consequently, there is a significant savings in the cost of just-in-time inventory.

To achieve these objectives, the protective housing 100 is configured with multiple elongate slots 150. Each of the slots 150 is disposed along at least one of the inner mold line (IML) surfaces 118, 120, 122 and is in fluid communication with one of the adjacent inner mold line (IML) surfaces 118, 120, 122. In the described embodiment, the plurality of slots 150 is disposed along the intermediate IML surface 118 and is in fluid communication with the first IML surface of the coaxial cable connector 102. Hence, the intermediate IML surface 122 corresponds to the body portion 112 of the connector 102 and the first IML, surface 118 corresponds to the coupler 110 of the connector 102.

Figure 4:
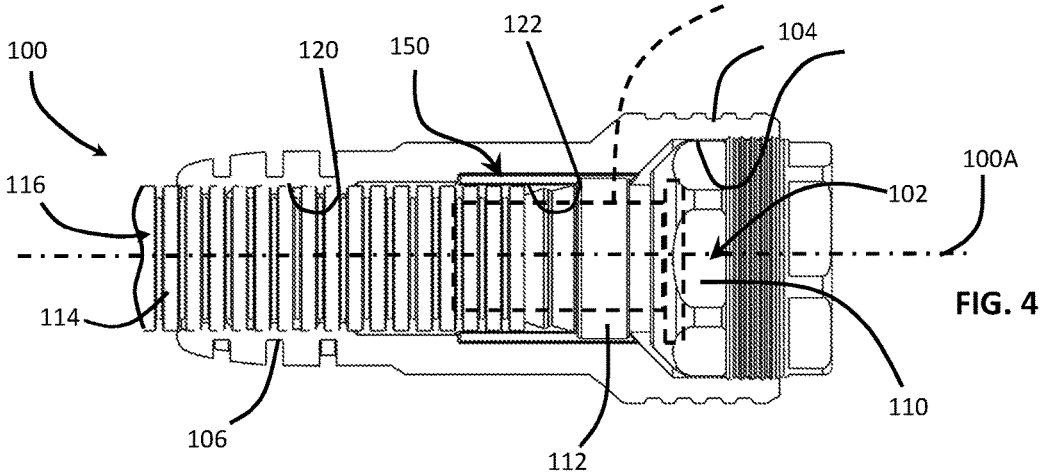
FIG. 4 is a cross-section view along the elongate axis of coaxial jumper cable which is disposed in combination with the weather protection boot according to the embodiment shown in FIGS. 1-3.
Figure 5:
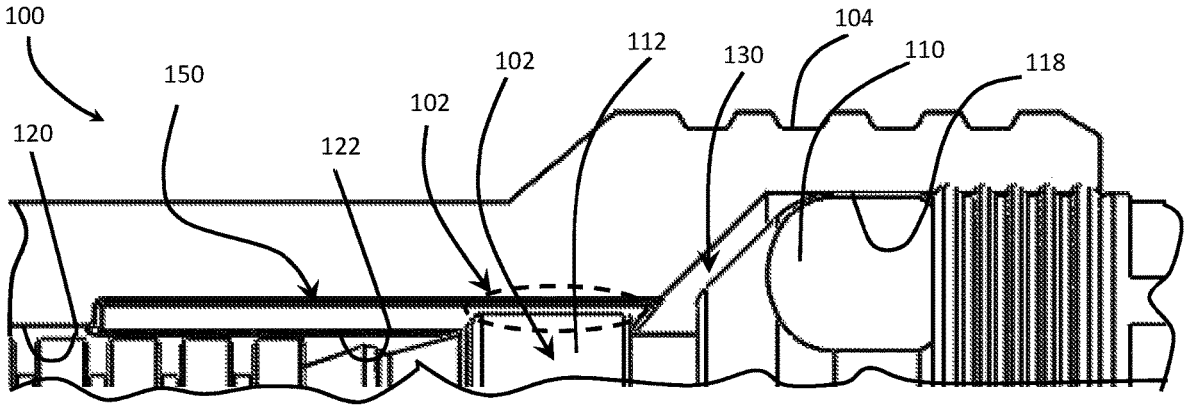
FIG. 5 is an enlarged sectional view of the weather protection boot showing the structure and function of the elongate slots relative to the body of the coaxial cable assembly.

In FIGS. 2, 4 and 5, a total of six (6) elongate slots 150 are disposed about the inner mold line surface 122 (best seen in FIG. 5) corresponding to the body 112 of the coaxial cable connector 102. Furthermore, the elongate slots 150 of the intermediate mold line surface 122, or intermediate diameter D2, are each in fluid communication with the adjacent first mold line surface 118 which corresponds to diameter D1. It will be appreciated that, in order to be in fluid communication with the first mold line surface 118, the elongate slots 150 must first be in fluid communication with a transition region 130 disposed between the first and intermediate IML surfaces 118, 122.

In the described embodiment, the elongate slots 150 are equiangularly-spaced and define an arc, or angle (3, of about sixty degrees (60°) from the centerline of one slot 150 to the centerline of an adjacent slot 150. Furthermore, the width dimension W of each elongate slot 150 defines an arc, or angle $\alpha$ of about 30 degrees (30°.) Consequently, and in accordance with this embodiment, the area of frictional engagement between each of the six (6) elongate slots 150 is equal to the expression $\alpha$*D2*W which is about ½ of the total area of engagement.

While the illustrated embodiment depicts six (6) elongate slots 150, the protective housing 100 may include as few as three (3) elongate slots 150 to as many as eight (8) elongate slots 150. The preferred embodiment, h includes between five (5) and seven (7) elongate slots 150. In FIGS. 3 and 4, the elongate slots 150 are substantially parallel to the longitudinal axis 100A of the protective housing 100 and are between about one-quarter inch (¼") inch to about three-quarter inches (¾") in length dimension. FIG. 5 shows an area of clearance 140 between each elongate slot 150 to: (i) facilitate assembly, i.e., prevent the build-up of air; and (ii) ease disassembly, i.e., by preventing suction from resisting the separation of the housing 100 from the connector 150. In the described embodiment, the minimum length LP1 of each elongate slot 150, as a function of the total length LT of the intermediate IML surface 118, is at least twenty-five 25%. The maximum length LP2 of each elongate slot 150 as a function of the total length LT is at least seventy-five 75%.

Additional embodiments include any one of the embodiments described above, where one or more of its components, functionalities or structures is interchanged with, replaced by or augmented by one or more of the components, functionalities or structures of a different embodiment described above.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

The following is claimed:

1. A protective housing for a jumper cable, comprising:

a flexible boot having an aperture for receiving a cable connector and comprising at least three portions corresponding to peripheral surfaces of the cable connector;

a first portion having a first inner mold line (IML) surface corresponding to a coupler portion of the cable connector at a first end;

a second portion having a second IML surface corresponding to a peripheral surface of the cable connector at a second end;

an intermediate portion having an intermediate IML surface corresponding to a body portion of the cable connector between the first and second ends;

and a plurality of elongate slots disposed along at least one of the IML surfaces and in fluid communication with one of the adjacent IML surfaces;

wherein a length of each of the plurality of elongate slots is between twenty-five percent (25%) of the total intermediate IML surface and seventy-five percent (75%) of the total intermediate IML surface; wherein the plurality of elongate slots reduce the flexible material in frictional engagement with the cable connector;

and wherein a width of each of the plurality of elongate slots defines an arc of 30 degrees.

2. The protective housing of claim 1 wherein the plurality of elongate slots is between three (3) to eight (8) elongate slots.

3. The protective housing of claim 1 wherein the plurality of elongate slots is between five (5) to seven (7) elongate slots.

4. The protective housing of claim 1 further comprising a transition region between the intermediate and the first IML surfaces and wherein each of the elongate slots is in fluid communication with the transition region.

5. The protective housing of claim 1 wherein the boot defines a longitudinal axis and wherein each elongate slot is parallel to the longitudinal axis.

6. The protective housing of claim 1 wherein the elongate slots are equiangularly-spaced about an inner circumference of the first IML surface.

7. The protective housing of claim 1 wherein the at least one of the first and second IML surfaces comprises a plurality of annular engagement rings to facilitate frictional engagement of the first and second IML surfaces.

8. The protective housing of claim 1 wherein at least one of the first and second IML, surfaces comprises a plurality of circumferential grooves formed along an outer circumference thereof.

9. The protective housing of claim 1, wherein the intermediate IML surface has a larger diameter than the first IML surface and a smaller diameter than the second IML surface.

10. The protective housing of claim 1 wherein the boot comprises a Polyvinyl Chloride (PVC) outer shell to protect the boot from being ingested by an indigenous bird population.

11. A protective housing for a telecommunications interface comprising:

a flexible boot having an aperture for receiving a cable connector and comprising at least three portions corresponding to peripheral surfaces of the cable connector;

a first portion having a first inner mold line (IML) surface corresponding to a coupler portion of the cable connector at a first end;

a second portion having a second IML surface corresponding to a peripheral surface of the cable connector at a second end;

an intermediate portion having an intermediate IML surface corresponding to a body portion of the cable connector between the first and second ends a plurality of elongate slots disposed along at least one of the IML surfaces and in fluid communication with one of the adjacent IML surfaces;

wherein the plurality of elongate slots provide a fluid to facilitate assembly and disassembly of the boot from the connector;

wherein a length of each of the plurality or elongated slots is between twenty-five percent (25%) of the total intermediate IML surface and seventy-five percent (75%) of a total intermediate IML surface;

wherein the plurality of elongate slots reduce the eliminate one-half (½) of the elastomeric flexible material in frictional engagement with the cable connector;

and wherein a width of each of the plurality of elongate slots defines an arc of 30 degrees.

12. The protective housing of claim 11, wherein the number plurality of elongate slots is between three (3) to eight (8) elongate slots.

13. The protective housing of claim 11, wherein the number plurality of elongate slots is between five (5) to seven (7) elongate slots.

14. The protective housing of claim 11, further comprising a transition region between the intermediate and the first IML surfaces and wherein each of the elongate slots is in fluid communication with the transition region.

15. The protective housing of claim 11, wherein the boot defines a longitudinal axis and wherein each elongate slot is parallel to the longitudinal axis.

16. The protective housing of claim 11, wherein the elongate slots are equiangularly-spaced about an inner circumference of the first IML surface.

17. The protective housing of claim 11, wherein the at least one of the first and second IML surfaces comprises a plurality of annular engagement rings to facilitate frictional engagement of the first and second IML surface.

* * * * *